US006602529B1

(12) United States Patent
Lonergan et al.

(10) Patent No.: US 6,602,529 B1
(45) Date of Patent: Aug. 5, 2003

(54) HIGH RAW SPECIFIC VOLUME DOUGH IN A CHUB

(75) Inventors: Dennis Arthur Lonergan, Medina, MN (US); Michael R. Perry, Plymouth, MN (US); Tammy L. McIntyre, Minneapolis, MN (US)

(73) Assignee: Pillsbury Company, Minneapolis, MN (US)

( * ) Notice: Subject to any disclaimer, the term of this patent is extended or adjusted under 35 U.S.C. 154(b) by 56 days.

(21) Appl. No.: 09/677,366

(22) Filed: Oct. 2, 2000

(51) Int. Cl.[7] ..... B65D 81/00; B65D 85/00

(52) U.S. Cl. ..... 426/128; 426/118; 426/8; 383/70; 383/71; 383/100; 383/103; 229/87.08; 229/87.09

(58) Field of Search ..... 426/118, 128, 426/395, 412, 8, 113; 383/71, 70, 100, 103; 229/87.08, 87.09, 87.11

(56) References Cited

U.S. PATENT DOCUMENTS

| | | | | | |
|---|---|---|---|---|---|
| 1,420,373 | A | * | 6/1922 | Fich | 426/395 |
| 1,811,772 | A | | 6/1931 | Willoughby | |
| RE18,426 | E | | 4/1932 | Willoughby | |
| 1,887,162 | A | | 11/1932 | Lorber | |
| 1,904,741 | A | | 4/1933 | Lorber | |
| 1,988,091 | A | | 1/1935 | Schumacher | |
| 2,266,700 | A | | 12/1941 | Abrams et al. | |
| 2,304,591 | A | | 12/1942 | Pape | |
| 2,478,618 | A | | 8/1949 | Armstrong et al. | |
| 2,700,805 | A | * | 2/1955 | Bedford | 383/70 |
| 2,845,356 | A | * | 7/1958 | Battiste | 426/395 |
| 2,949,369 | A | | 8/1960 | Zoeller et al. | |
| 2,986,319 | A | * | 5/1961 | Bierman et al. | 426/118 |
| 3,041,801 | A | * | 7/1962 | Harrison | 383/70 |
| 3,102,818 | A | | 9/1963 | Zoeller et al. | |
| 3,273,300 | A | | 9/1966 | Watrous et al. | |
| 3,301,687 | A | * | 1/1967 | Davy | 383/103 |
| 3,304,185 | A | | 2/1967 | Fortney | |
| 3,308,936 | A | * | 3/1967 | Roland et al. | 383/71 |
| 3,397,064 | A | | 8/1968 | Matz | |
| 3,432,980 | A | * | 3/1969 | Seiferth et al. | 383/71 |
| 3,436,232 | A | * | 4/1969 | Taylor et al. | 426/8 |
| 3,510,050 | A | | 5/1970 | Culley et al. | |
| 3,524,401 | A | | 8/1970 | Hosfield et al. | |
| 3,658,562 | A | | 4/1972 | Wilson | |
| 3,780,488 | A | * | 12/1973 | Herrell | 383/71 |
| 3,879,563 | A | | 4/1975 | Tucker et al. | |
| 3,937,396 | A | | 2/1976 | Schneider | |
| 4,049,836 | A | | 9/1977 | Davis, Jr. | |
| 4,120,984 | A | | 10/1978 | Richardson et al. | |
| 4,381,315 | A | | 4/1983 | Yong et al. | |
| 4,388,336 | A | | 6/1983 | Yong et al. | |
| 4,415,598 | A | | 11/1983 | Chen et al. | |
| 4,526,801 | A | | 7/1985 | Atwell | |
| 4,590,078 | A | * | 5/1986 | Umina | 426/118 |
| 5,084,284 | A | | 1/1992 | McDilda et al. | |
| 5,314,702 | A | | 5/1994 | Lewandowski et al. | |
| 5,366,744 | A | | 11/1994 | Drummond et al. | |
| 5,547,694 | A | | 8/1996 | Perry et al. | |
| 5,643,625 | A | | 7/1997 | Perry et al. | |

FOREIGN PATENT DOCUMENTS

| | | | | |
|---|---|---|---|---|
| JP | 61-47498 | * | 10/1986 | 426/113 |

* cited by examiner

*Primary Examiner*—Steve Weinstein
(74) *Attorney, Agent, or Firm*—Faegre & Benson, LLP

(57) ABSTRACT

A dough product suitable for storage by refrigeration or freezing that includes a package constructed as a chub from a substantially gas impermeable material closed at opposite ends around a dough portion containing at least flour, a liquid, and a leavening system. The package includes at least one gas transfer passage. The leavening system at least partially proofs the dough after insertion into and closing of the package, such that the dough expands to a volume substantially equal to the volume of the package and has a high raw specific volume. The proofed dough bears against and seals the gas transfer passage to thereby arrest further proofing and prevent oxygen entry into the package. The dough product is then stored at refrigeration or freezing temperatures for later baking, without additional proofing, into a bread product having a high baked specific volume.

6 Claims, 4 Drawing Sheets

HIGH RAW SPECIFIC VOLUME DOUGH IN A CHUB

FIELD OF THE INVENTION

This invention relates to packaging for refrigerated and frozen dough, particularly pre-proofed dough.

BACKGROUND OF THE INVENTION

A wide variety of prepared bread and bread-like dough products are currently available which allow a user to "home bake" the dough to produce a desirable hot, fresh-baked item. These bread and bread-like dough products generally contain a substantial leavening ingredient and include, but are not limited to, loaves of bread, such as French bread, white bread or whole wheat bread, bread sticks, biscuits, rolls, pizza dough and the like, and will be referred to hereinafter generally as "bread dough." These varieties of prepared bread dough products are currently sold in both frozen and refrigerated forms. Users generally favor the refrigerated products over the frozen products, however, because refrigerated bread dough does not need time to thaw and typically does not need time to rise prior to baking. Therefore, the refrigerated bread dough is ready to bake at any time.

Although refrigerated bread dough is preferable with respect to ease of use and preparation time, the storage of such dough is somewhat more complicated than storing frozen bread dough. One reason is that at least some leavening systems used with bread dough permit the dough to rise at refrigeration temperatures. The process through which bread dough rises in response to the activity of the leavening system is referred to in the industry as "proofing". Thus, storage packages for refrigerated bread dough must accommodate some degree of proofing during storage without rupturing.

Currently, refrigerated bread dough is stored in composite canisters which allow the refrigerated bread dough to proof while in the canister. As shown in FIG. 1, the canister is usually formed from composite paper board spirally wound into a cylinder which is disposed between a pair of end caps that are not hermetically sealed. The volume of dough packed into the canister is usually less than the canister volume, and as the dough proofs and expands, the pressure increases substantially so as to force the dough against the canister end caps to seal gas passages around the end caps of the canister. The overall volume of the dough after proofing, which is equal to the interior volume of the canister, divided by the initial weight of the dough is referred to as the raw specific volume ("RSV") of the product. A typical RSV value for refrigerated bread dough in a canister is usually in the range of 1.0 to 1.5 cubic centimeters per gram, with a typical value of 1.2 cubic centimeters per gram. Once the bread dough is baked, the overall volume of the baked bread item divided by the weight of the bread is referred to as the baked specific volume ("BSV") of the product. A typical BSV value for refrigerated bread dough in a canister that bakes into a bread loaf is usually in the range of 3.0 to 4.0 cubic centimeters per gram. Higher BSV values are usually preferred because the baked item tends to be larger and lighter relative to the initial amount of dough provided.

Although the use of canisters for refrigerated dough has provided satisfactory results in the past, this type of storage suffers from various limitations, for example, the packaging costs associated with such canisters are relatively high. In addition, the BSV values of the bread formed from the dough packaged in the canister tend to be rather low. One reason for this is because the RSV values of the packaged dough are limited by the canister package. In order to obtain a good seal around the end caps, a relatively low RSV value is usually required, which in turn results in a relatively low BSV value upon baking of the dough. To produce larger loaves of baked bread and thus larger BSV values, larger canisters and/or larger amounts of bread dough are required, which in turn increases the production costs of the product.

Another current form of storage for food products, including those that may be refrigerated and/or frozen, is a package known in the industry as a "chub," as shown in FIG. 2. The chub usually includes a tubular package of thin, flexible material that is filled with a quantity of food item. The tubular package ends may be closed by any appropriate means, but are often clamped shut by crimped clips. Although the chub has been demonstrated as being useful in packaging numerous types of food items, including cookie dough, sausage, ground meats, polenta and butter, use with a food product that often requires a substantial amount of proofing has not been demonstrated.

SUMMARY OF THE INVENTION

A dough product that may be refrigerated or frozen includes a package constructed as a chub from a substantially gas impermeable material with a dough portion disposed inside the package. The dough portion includes at least flour, a liquid, such as water, and a leavening system that causes the dough portion to expand or proof The package includes gas transfer passages that allow for gas to exit the package as the dough portion proofs. The passages may be formed by closing of the package ends with clips leaving a small opening at one or more ends of the package. As the dough portion proofs it bears against the interior of the package to seal the gas transfer passages and prevent oxygen re-entry. The dough product in the chub may be stored at a refrigeration temperature or at a frozen temperature, as needed to obtain a desired shelf life. Frozen bread dough products in accordance with the present invention may be directly baked upon removal from the freezer, and need not be either thawed or proofed prior to baking.

A method of making a dough product includes providing a package constructed from a flexible, substantially gas impermeable material with the package having at least one opening. A portion of bread dough is prepared which includes at least flour, a liquid, such as water, and a leavening system, and the dough portion is inserted into the package through the opening. The package is closed to encase the dough. The package is not sealed against gas transfer, however, but instead includes at least one gas transfer passage. The dough is then allowed to proof and expand within the package, such that gas is expelled through the gas transfer passage until the dough effectively seals the package by plugging the passage and arresting further proofing of the dough. The proofed bread dough product may then be stored at refrigeration or frozen temperatures.

DETAILED DESCRIPTION OF THE INVENTION

With reference to the attached Figures, it is to be understood that like components are labeled with like numerals throughout the several Figures.

Figure 1:
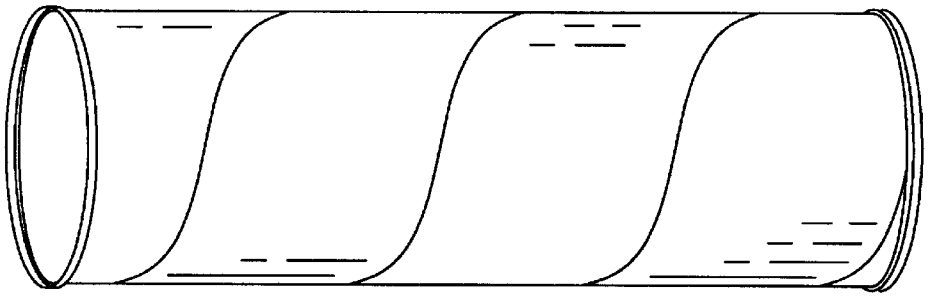
Fig. 1 (Prior Art)
FIG. 1 is a perspective view of a refrigeratable dough composite canister in accordance with the prior art.
Figure 2:
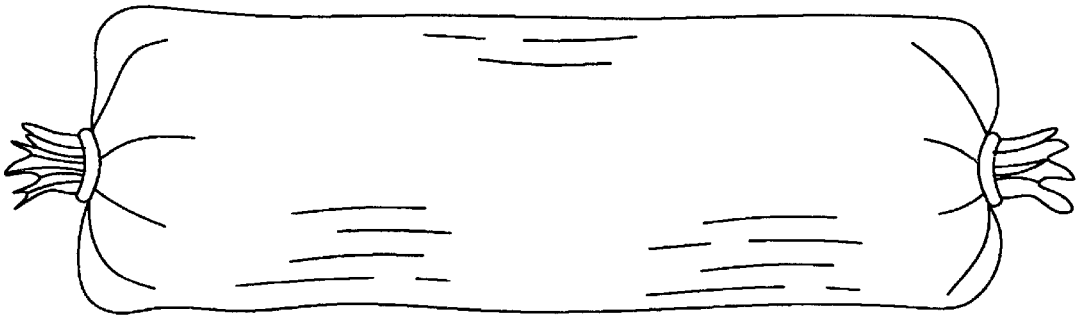
Fig. 2 (Prior Art)
FIG. 2 is a side elevation view of a food product formed as a chub in accordance with the prior art.
Figure 3:
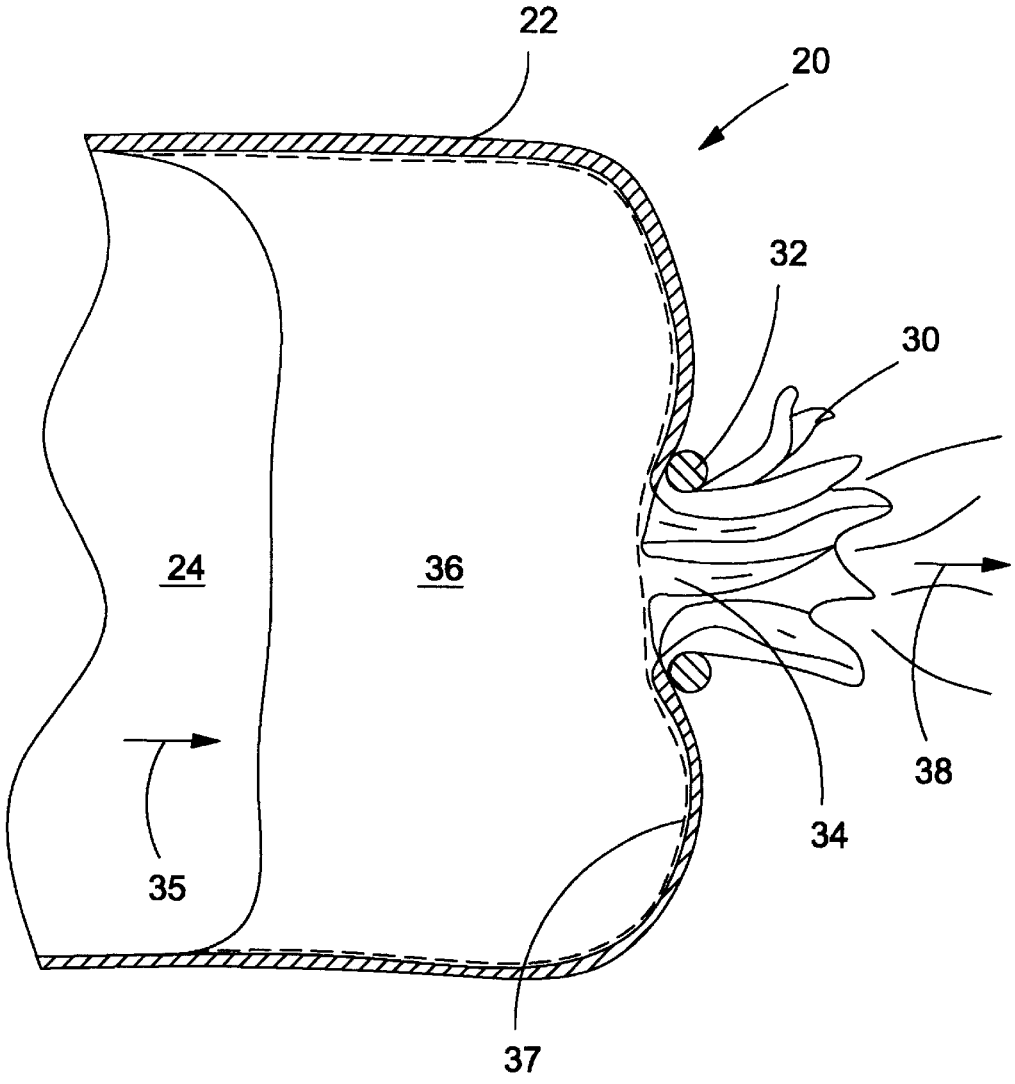
FIG. 3 is a partial section view of one embodiment of a dough product in accordance with the present invention, including a dough package encasing a dough portion that is not yet proofed.
Figure 4:
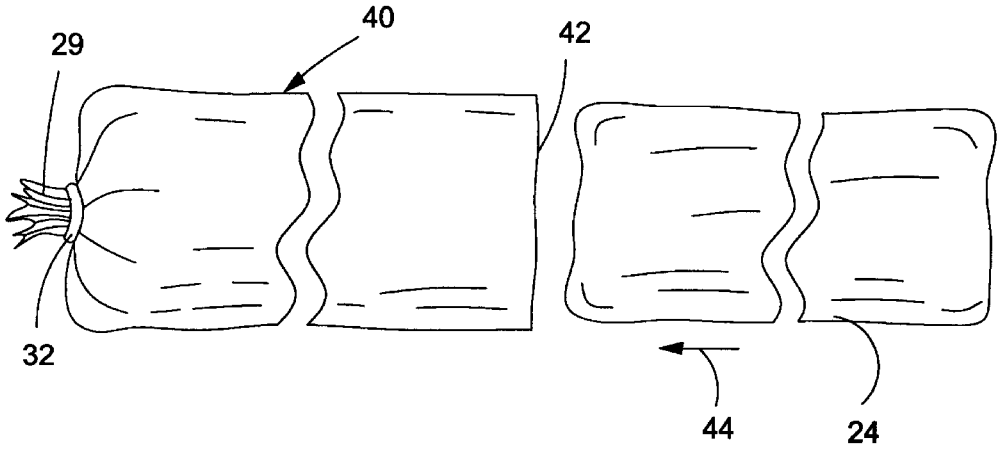
FIG. 4 is a side elevation view of the dough portion being loaded into the dough package as partially shown in FIG. 3.

FIG. 3 is a partial sectional view of a dough product 20 formed and packaged in accordance with the present invention, using a chub packaging configuration for a proofable dough. The dough product 20 includes a package 22, which is shown containing a dough portion 24 that is not yet fully proofed. As shown in FIG. 4, the package 22 may be formed as a hollow, elongate cylinder or tube 40 from a substantially gas impermeable material, such as, but not limited to, foil-laminated polyester film, that is relatively flexible, but yet is relatively non-elastic and non-expandable. A gas impermeable material that restricts the passage of gases, and functions as an oxygen and carbon dioxide barrier is preferred in order to more particularly control gas passage from the package 22 and prevent undesired oxygen reintroduction into the package 22. The tube 40 may be formed by cutting portions of the film to a desired size and rolling each portion over upon itself to form a tubular shape with overlapped edges. The edges may then be sealed at the seam produced by the overlapped edges.

Figure 5:
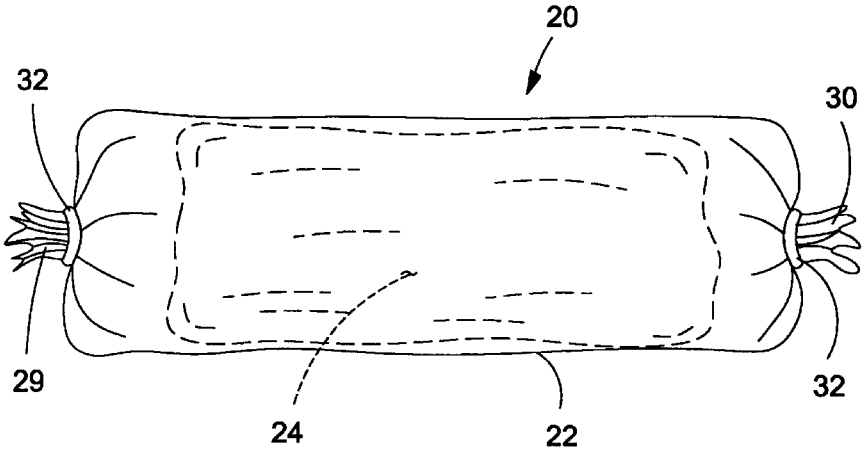
FIG. 5 is a side elevation view of the dough product as formed in FIG. 4.

In this embodiment, an end 29 of the tube 40 is gathered and substantially closed by crimped clip 32 which encircles the material of end 29 and pinches the material together. The other end 42 is left open to facilitate insertion of the dough portion 24. Once the dough portion 24 is positioned within the tube 40, the other end 30 may also be gathered and substantially closed by another crimped clip 32, resulting in package 22, as shown in FIG. 5. Alternatively, the dough portion 24 may be placed adjacent the film portion prior to formation of the tube 40 and closing of the ends 29, 30, so that the package 22 is formed around the dough portion 24. Other chub formation methods may also be used, as known in the art, as long as they are compatible with a leavened dough product and do not negatively impact the dough and its ability to proof subsequent to packaging.

Dough portion 24 is a bread dough formed in a manner known in the art from at least flour, a liquid, including but not limited to water, and a leavening system. Known leavening systems include traditional baking soda (sodium bicarbonate) combined with sodium acid pyrophosphate (SAPP) which is an acidulent; fat encapsulated sodium bicarbonate combined with gluconic-delta-lactone (GDL/E); yeast; substrate limited yeast; or supercritical carbon dioxide incorporated during mixing. It should be noted that if supercritical carbon dioxide is employed as the leavening system, it is generally necessary to place dough portion 24 into tube 40 in a pressurized packaging system wherein the entire packaging process occurs under pressure.

To prepare dough portion 24, the dry ingredients are mixed with the liquid until a dough mass is formed. The dough mass is further mixed in order to incorporate the leavening system. The completed dough is then removed from the mixer and cut into individual dough portions 24. It is to be understood that the weight of the individual dough portions 24 may vary depending on the baked bread product to be produced, as well as the volume of the package 22 used to contain the dough portion 24. It is the ratio of the package volume to dough weight that is important, not the specific weight of the dough itself. Each dough portion 24 may then be molded into a tubular shape and is typically coated with a dusting of flour. As described above, dough portion 24 may then be placed into tube 40 through the open end 42, as shown by arrow 44. It is to be noted that after first end 29 is closed, the interior of tube 40 may be coated with an appropriate oil, or other lubricant, in order to more easily receive dough portion 24.

Referring to FIG. 5, the closed ends 29, 30 allow the package 22 to encase the dough portion 24 and prevent the dough portion 24 from escaping. The ends 29, 30 are not entirely sealed, however, but instead include at least one gas transfer passage to permit gas flow out of the package 22 as the dough portion 24 proofs. Referring again to FIG. 3, a gas passage 34 is shown formed within the end 30 by not pinching the gathered end 30 until it is fully closed, but rather by applying crimped clip 32 in a manner that leaves an appropriately sized opening in end 30. Passage 34 is sized to permit the outflow of gas from the package 22, yet is small enough to prevent any of the dough portion 24 from also flowing out of the package 22. Vent rates of gas outflowing through the passage 34 may typically be in the range of about 1.5 to about 150 cubic centimeters per minute at Δ1 pounds per square inch ("psi") (that is, at a pressure inside the package 22 that is one psi greater than the pressure outside the package 22).

Although the package 22 is shown in this embodiment to be closed with crimped clips 32, other types of end sealing devices or methods may also be used that provide one or more gas transfer passages for the package 22. Alternatively, other types of gas transfer passages may also be provided for the package 22 that are not formed at the ends. However, use of the gathered and semi-closed ends that are part of the traditional chub configuration to form the gas transfer passages takes advantage of an established food handling and packaging technique. Formation of the dough product 20 of the present invention, therefore, may be practiced upon existing manufacturing equipment useful in preparing other chub packaged food items, such as cookie dough chubs, thereby reducing the manufacturing and packaging costs of the dough product 20.

It is to be understood that this embodiment is illustrative only and is not meant to limit the present invention in any way. Other suitable embodiments will be evident to those skilled in the art, and it is to be understood that such other embodiments are within the scope and spirit of the present invention.

When not fully proofed, dough portion 24 has a volume less than that of package 22, as shown in FIGS. 3 and 5. As the dough portion 24 proofs, it expands into a provided space 36 in a direction toward the end 30, as shown by arrow 35. As dough portion 24 expands to substantially fill space 36 (as indicated by dashed line 37), air and other gases escape out passage 34 as indicated by arrow 38 until passage 34 becomes sealed gas tight by the dough portion 24 itself. At the same time, sealing of any other passages, such as in the other end 29, also occurs by expansion of the dough portion 24. Thus, when dough portion 24 occupies substantially the entire internal volume of package 22, proofing is halted by the effective sealing of the passages. It is to be understood that with any of the above described known leavening systems, it is generally necessary to employ a sufficient quantity of leavening relative to the quantity of dough to expand the dough portion 24 such that it is able to expel the air from package 22 and to cause the dough portion 24 to seal the gas passages, such as passage 34, and produce a positive pressure inside package 22. However, use of too large a quantity of leavening should be avoided, so as to minimize the risk of expansion of the dough portion 24 beyond the volume of the package 22 and potential rupture of the package 22. The sealing action then also prevents any oxygen from being introduced back into the package 22, thereby preserving the integrity of dough portion 24 within dough product 20.

Once the dough portion 24 has fully proofed, the dough portion 24 within the package 22 preferably has a RSV value of about 1.5–3.0 cubic centimeters per gram, and more preferably of about 2.0–2.5 cubic centimeters per gram. The RSV values of dough packaged in accordance with the present invention are typically higher than those of refrigerated dough packaged in prior art canisters of the type described in the Background section. The packaging structure of the present invention ensures consistent sealing of the package at higher RSV values, which is not typically possible with the canister packaging. As stated above, to produce these higher RSV values with prior art packaging, provision of a larger volume package for a specific dough weight, or a reduction in dough weight for a specific volume package, must occur, thereby increasing the production costs or detrimentally affecting the consumer product.

After formation, dough product 20 is preferably stored at about 70° F. (about 21° C.) until dough portion 24 is at least partially proofed. Dough product 20 is then stored at refrigeration temperatures of about 40° F. (about 4° C.) during which time final proofing occurs and the dough portion 24 expands to fill the volume of package 22 and seal the ends 29, 30, thereby arresting further proofing of the dough portion 24. Final proofing of the dough portion 24 typically occurs in about 10–14 days when stored at 40° F. Storage at refrigeration temperatures slows down the proofing process, but increases storage life of the dough product 20. Optionally, a partially or fully proofed dough product 20 may be frozen and stored in a frozen state to provide an even longer storage life for the dough product 20.

When fully proofed, dough portion 24 may continue to be stored at refrigeration temperatures, or may be removed from package 22 and baked on a greased baking sheet or other suitable surface. The length of time and temperature at which the dough portion 24 is baked is based on the type of bread dough, typically about 30 minutes at about 375° F. (about 190° C.), or until the center temperature is about 209° F. (about 98° C.), for a bread loaf, such as a French bread. However, other times and temperatures may be used for other types of bread dough products.

Upon baking, the dough portion 24 becomes a baked product having a BSV value preferably in the range of about 4.0 to 5.0 cubic centimeters per gram, which is typically higher than bread products baked from the refrigerated canister bread dough discussed above. Larger RSV values tend to produce larger BSV values upon baking. However, as illustrated below in Example 3, even at the same starting RSV value, dough packaged in a chub according to the present invention will still produce baked product at a higher BSV value than dough packaged in a prior art canister. Besides providing a larger baked bread product from the same initial amount of bread dough, which is preferred by consumers, the dough product 20 of the present invention is able to produce a baked bread product having the taste and texture necessary to meet consumer expectations.

Figure 6:
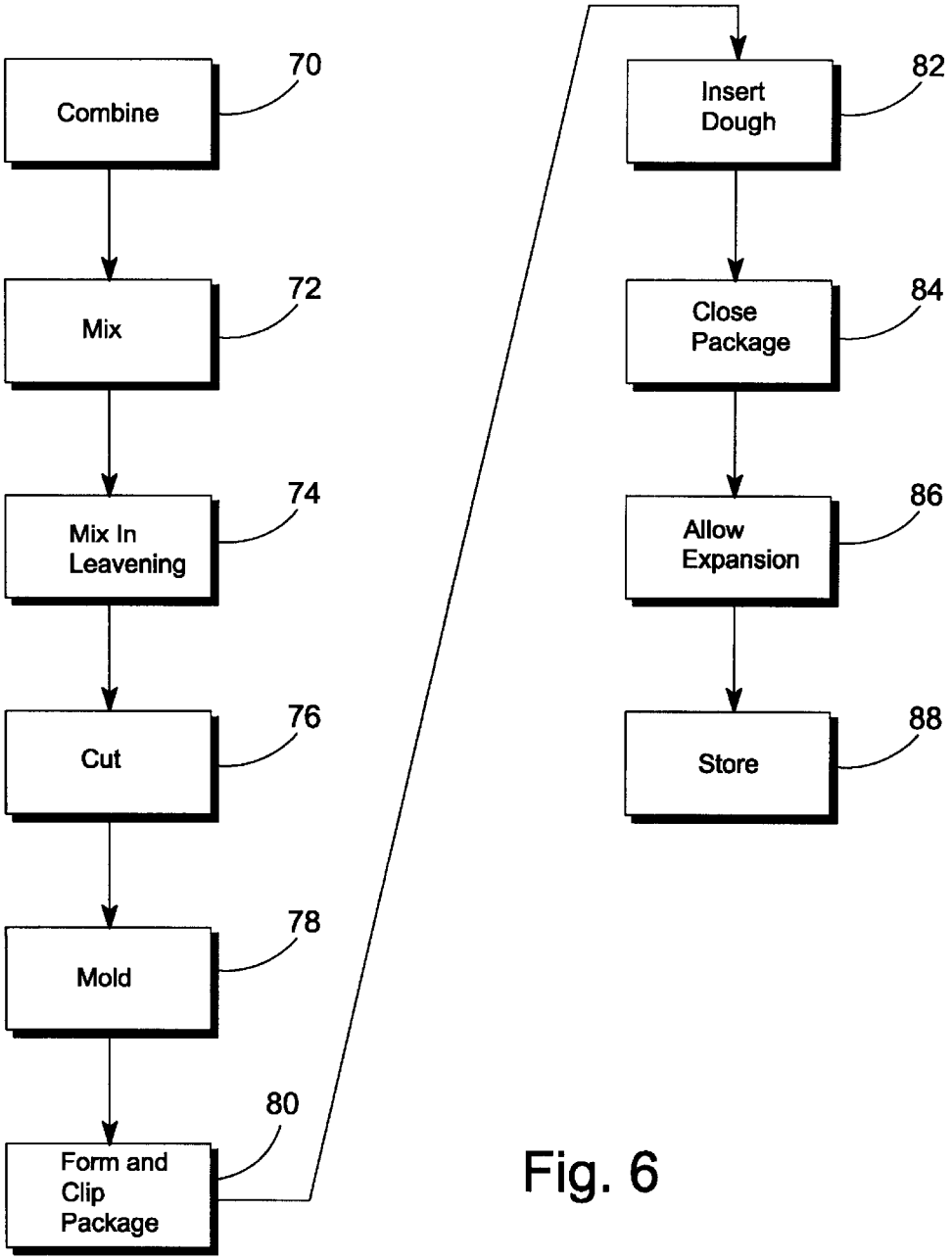
FIG. 6 is a flow diagram showing steps performed for making a refrigeratable bread dough product in accordance with the present invention which may then be frozen.

FIG. 6 is a system flow diagram illustrating a method for making dough products in accordance with the present invention that are then stored in a frozen state. The method begins at block 70 where the dry ingredients, such as flour, are combined with water or other liquid ingredients. At block 72, the dry and liquid ingredients are mixed until a dough mass is fully developed. At block 74, a leavening agent is mixed into the dough mass to form the final dough. At block 76, the dough is removed and cut into slabs of a desired weight. At block 78, the dough is molded into a tubular shape.

At block 80, a tubular package is formed from an appropriate material and one end of the package is closed by a first clip with the other end left open. At block 82, the molded dough is placed into the tubular package through the open end. At block 84, the open end of the package is closed with a second clip. At block 86, the packaged dough is allowed to fully expand at a temperature of about 70° F. (about 21° C.). Finally, at block 88, the fully proofed packaged dough product is stored at approximately −11° F. (about −24° C.) until ready for use. When fresh-baked bread is desired, the packaged dough product is removed from the freezer, the frozen dough is removed from the package and placed on a baking sheet. The dough is then baked at about 375° F. (about 190° C.) for about 35 minutes until done. Such frozen proofed bread dough allows for both long-term storage and immediate baking without thawing or proofing, thereby providing consumer friendly, quick and easy, fresh-baked goods.

EXAMPLE 1

In a first example, a dough product was formed from a bread dough packaged in a chub, as described above. The bread dough contained flour, water and a leavening system level of 125% GDL/E. The resulting dough portion had dough weight of about 330 grams and an initial package volume of about 800 cubic centimeters providing an RSV of about 2.65 cubic centimeters per gram after proofing in the package. After storage at about 40° F. for one month, the dough produced a bread loaf having a bread weight of about 289 grams and a bread volume of about 1450 cubic centimeters providing a BSV of about 5 cubic centimeters per gram.

EXAMPLE 2

Another such dough product was formed as stated in EXAMPLE 1, but was stored frozen at about −11° F. (about −24° C.) for two weeks. The resulting dough weight was initially about 355 grams and the initial package volume was about 958 cubic centimeters, providing an RSV of about 2.7 cubic. centimeters per gram. The resulting bread weight was about 312 grams with a bread volume of about 1,715 cubic centimeters resulting in a BSV of about 4.8 cubic centimeters per gram.

EXAMPLE 3

An experiment was performed to compare the BSV of dough stored in a chub in accordance with the present invention with that of dough stored in a prior art canister. The dough in the two different packages had the same RSV value, but baked up to different BSV values with the chub dough at considerably higher values. The results of the experiment are set forth in tie table below.

Baked Specific Volume for Dough Product Stored in Chubs vs. Canisters for up to 90 days @40° F.

| Package type | Raw Specific Volume | Time to proof | Baked Specific Volume 30 day BSV | 60 day BSV | 90 day BSV |
|---|---|---|---|---|---|
| Chub (633 cc volume) | 2.7 cc/g | 11 hours | 4.8 | 4.6 | 4.3 |
| Can (633 cc volume) | 2.7 cc/g | 28 hours | 3.3 | 3.2 | 3.1 |

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention. For example, although the present invention has been described with respect to bread dough, it is applicable to any food product which is proofed to some extent after packaging. Further, some outgassing may be facilitated by flattening the flexible package containing the dough to thereby squeeze excess air from the package and minimize headspace.

What is claimed is:

1. A packaged dough product suitable for storage by refrigeration or freezing comprising:

a chub package constructed from a substantially oxygen and carbon dioxide gas impermeable material that is relatively flexible but is relatively non-elastic and non-expandable, the package having an interior volume and the package including at least one gas transfer passage through a substantially closed, crimped clip end of said chub package; and a dough portion in a non-proofed state disposed inside the chub package, spaced from said passage, the dough portion containing at least flour, liquid and a leavening system, the dough portion having a volume smaller than the interior volume of the package; said passage being sufficient to allow gas flows out of the package through the passage during proofing of the dough portion in the package, yet small enough to prevent any of the dough portion from flowing out of the package; said dough portion and said leavening system being present in the package in an amount sufficient such that the dough portion will undergo proofing in the package and expand to cause the dough portion to expel air from the package and cause the dough portion to completely fill the volume of the chub package and substantially seal the gas passage to prevent entry of oxygen and to produce a positive pressure in the package and provide the dough portion in a proofed state.

2. The dough product of claim 1, wherein the at least one crimped clip end comprises a first end that includes a first gas transfer passage, and wherein the package further comprises a second crimped clip and at an opposite end of the package from it the first end, the second crimped clip end including a second gas transfer passage.

3. The dough product of claim 1, wherein the gas impermeable material comprises foil-laminated plastic.

4. The dough product of claim 3, wherein the foil-laminated plastic comprises foil-laminated polyester.

5. The dough product of claim 1, wherein the dough portion is bread dough and is capable of having a raw specific volume of at least about 1.5 cubic centimeters per gram in the package after proofing.

6. The dough product of claim 5, wherein the bread dough is further capable of having a baked specific volume of at least about 4.0 cubic centimeters per gram after baking into a baked bread product.

* * * * *